US007169528B2

(12) United States Patent
Yoon et al.

(10) Patent No.: US 7,169,528 B2
(45) Date of Patent: Jan. 30, 2007

(54) PROCESS FOR PREPARING COLORED TONER PARTICLES

(75) Inventors: Hichang Yoon, Fairport, NY (US); Bret Martin Johnston, Dansville, NY (US); Dinesh Tyagi, Fairport, NY (US); Michael Thomas Regan, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 363 days.

(21) Appl. No.: 10/836,772

(22) Filed: Apr. 30, 2004

(65) Prior Publication Data

US 2005/0244738 A1 Nov. 3, 2005

(51) Int. Cl.
*G03G 9/08* (2006.01)

(52) U.S. Cl. ..... 430/137.14; 523/339

(58) Field of Classification Search ..... 430/137.14; 523/339

See application file for complete search history.

(56) References Cited

U.S. PATENT DOCUMENTS

RE31,072 E 11/1982 Jadwin et al.
4,833,060 A 5/1989 Nair et al.
4,965,131 A 10/1990 Nair et al.
5,247,034 A 9/1993 Mate et al.
5,262,268 A 11/1993 Bertrand et al.
5,290,654 A * 3/1994 Sacripante et al. .... 430/137.14
5,968,700 A 10/1999 Tyagi et al.
6,482,562 B2 * 11/2002 Ezenyilimba et al. .. 430/137.14

* cited by examiner

*Primary Examiner*—Christopher RoDee
(74) *Attorney, Agent, or Firm*—Carl F. Ruoff

(57) ABSTRACT

A process for the preparation of colored polymeric toner particles includes: forming an organic phase by dissolving an organic polymer and, optionally, one or more additives in a water-immiscible organic solvent; forming a dispersion by combining the organic phase with an aqueous phase comprising a particulate stabilizer, a colorant, and, optionally, a promoter, with the proviso that when the colorant is carbon black, it is an acidic carbon black having a pH less than 7; homogenizing the dispersion to form droplets containing the organic solvent, organic polymer, and colorant; removing the organic solvent from the droplets to form colored polymeric toner particles; and separating and drying the toner particles.

18 Claims, No Drawings

PROCESS FOR PREPARING COLORED TONER PARTICLES

FIELD OF THE INVENTION

The present invention relates in general to electrostatographic imaging and, more particularly, to colored polymeric toner particles suitable for use in electrostatographic toner compositions, and to a process for preparing the particles.

BACKGROUND OF THE INVENTION

Polymer particles can be prepared by a process frequently referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent. The resultant particles are then isolated, washed, and dried.

In the practice of this technique, polymer particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water-insoluble solid particulate suspension stabilizer, typically silica or latex, and the size of the solvent-polymer droplets produced by mechanical shearing using rotor-stator type colloid mills, high pressure homogenizers, and the like.

Limited coalescence techniques, which typically result in the formation of polymer particles having a substantially uniform size distribution, have been described in numerous patents pertaining to the preparation of electrostatic toner particles. Such procedures employed in toner preparation are described in, for example, U.S. Pat. Nos. 4,833,060 and 4,965,131, the disclosures of which are incorporated herein by reference. The described procedures typically consist of the following steps: mixing a polymer material, a solvent and, optionally, a colorant and a charge control agent to form an organic phase; dispersing the organic phase in an aqueous phase comprising a particulate stabilizer and homogenizing the mixture; evaporating the solvent; and washing and drying the resultant product.

The limited coalescence technique just described requires that the colorant be dispersed in the organic phase. However many pigments in powder form have limited solubility in water-immiscible organic solvents. Also, in many cases, colorants are received as water-wet pigment cakes. U.S. Pat. No. 5,262,268 discloses a method of forming colored toner from a pigment wet cake by melt blending it with a toner resin in an extruder, and removing water from the extruder. Colorants in wet cake form may be cheaper in price than in dry powder, flush or master batch form, but they cannot be dispersed in an organic phase by the prior art procedures described in U.S. Pat. Nos. 4,833,060 and 4,965,131. Also, when the colorant needs to be milled for improved dispersion, milling can be carried out more safely in an aqueous medium than in an organic medium, thereby providing an aqueous dispersion of the colorant suitable for use in the process of the present invention.

SUMMARY OF THE INVENTION

In accordance with the present invention, the limitations of the prior art are effectively obviated by a novel process in which colorants are introduced into the aqueous rather than the organic solvent phase of a limited coalescence process. A colorant in the form of a dry powder, a wet cake, or a milled aqueous dispersion is dispersed in the aqueous phase, forming an aqueous dispersion that is characterized a predetermined and narrow size distribution of solvent droplets containing dissolved polymer and the colorant. Removal of the organic solvent results in the formation of colored polymeric toner particles.

Thus, the present invention is directed to a process for the preparation of colored polymeric toner particles that comprises:

a) forming an organic phase by dissolving an organic polymer and, optionally, one or more additives in a water-immiscible organic solvent;

b) forming a dispersion by combining the organic phase with an aqueous phase comprising a particulate stabilizer, a colorant, and, optionally, a promoter, with the proviso that when the colorant is carbon black, it is an acidic carbon black having a pH less than 7;

c) homogenizing the dispersion, thereby forming droplets containing the organic solvent, organic polymer, and colorant;

d) removing the organic solvent from the droplets, thereby forming colored polymeric toner particles; and e) separating and drying the colored polymeric toner particles.

DETAILED DESCRIPTION OF THE INVENTION

In accordance with the process of the present invention, an organic polymer and, optionally, a charge control agent are dissolved in a water-immiscible organic solvent to form a solution, which is dispersed in water containing a colloidal stabilizer such as silica, a colorant and, optionally, a promoter to form an aqueous suspension of droplets that is subjected to high shear to reduce droplet size and form limited coalescence particles. The water immiscible organic solvent is then removed so as to produce a suspension of particles having a narrow size distribution. The water is then removed and the toner composition recovered. A polymeric latex can be used as a stabilizer, as described in the previously mentioned U.S. Pat. No. 4,965,131.

The present invention is applicable to the preparation of polymeric particles from any type of polymer that is capable of being dissolved in a solvent that is immiscible with water and includes combinations of polymers. Useful binder polymers include vinyl polymers, for example, homopolymers, and copolymers that include styrene monomers, as well as monomer condensation polymers such as polyesters.

A vinyl aromatic monomer such as styrene can be copolymerized with a second monomer selected from the group consisting of conjugated diene monomers and acrylate monomers such as alkyl acrylates and methacrylates. Particularly useful binder polymers are styrene polymers containing about 40–100 wt. % of styrene monomers and about 0–60 wt. % of one or more alkyl acrylate or methacrylate monomers. Fusible styrene-acrylic copolymers that are covalently lightly crosslinked with a divinyl compound such as divinylbenzene, as disclosed in U.S. Reissue Pat. No. 31,072, are also useful.

Yet another useful binder polymer composition comprises a copolymer of a vinyl aromatic monomer, a second monomer selected from the group consisting of conjugated dienes and alkyl acrylates and methacrylates, and an amino acid soap, for example, the salt of an α-alkylaminoacetic acid whose alkyl group contains about 10–20 carbon atoms. Binder polymer compositions of this type, with a third monomer that is a crosslinking agent, are described in U.S. Pat. No. 5,968,700, the disclosure of which is incorporated herein by reference. Similar polymer compositions without the crosslinker are prepared by the process described in U.S. Pat. No. 5,247,034, the disclosure of which is incorporated herein by reference.

Other useful binder polymers are polyesters of aromatic dicarboxylic acids with one or more aliphatic diols, for example, polyesters of isophthalic or terephthalic acid with diols such as ethylene glycol, cyclohexanedimethanol, and bisphenols.

Various additives such as charge control agents, waxes, and lubricants that are generally present in electrostatographic toners may be added to the polymer prior to or concurrently with its dissolution in the solvent. A very wide variety of charge control agents, which modify the triboelectric charging properties of the resulting toner, are available for positive charging toners. A large but lesser number of charge control agents for negative charging toners are also available. Suitable charge control agents are disclosed, for example, in U.S. Pat. Nos. 3,893,935; 4,079,014; 4,323,634; 4,394,430; 4,624,907; 4,814,250; 4,840,864; 4,834,920; 4,683,188; and 4,780,553, and British Patent Nos. 1,501,065 and 1,420,839. Charge control agents are generally employed in small quantities, about 0.1–5 wt. % based upon the weight of the toner. Mixtures of charge control agents can be used.

Any suitable solvent that will dissolve the polymer and which is also immiscible with water may be used, for example, dichloromethane, ethyl acetate, propyl acetate, methyl ethyl ketone, trichloromethane, carbon tetrachloride, ethylene chloride, trichloroethane, toluene, xylene, cyclohexanone, and 2-nitropropane. Particularly useful solvents are ethyl acetate, propyl acetate, and dichloromethane because they are good solvents for many polymers and also are sufficiently volatile to enable their ready removal by evaporation from the discontinuous phase droplets.

Useful particulate stabilizers include highly cross-linked polymeric latex materials of the type described in U.S. Pat. No. 4,965,131, and also inorganic oxides such as colloidal silica. Colloidal silica, which is preferred, is used in an amount ranging from about 1 part to about 15 parts based on 100 parts of the total solids. The size and concentration of the particulate stabilizers determine the size of the final toner particles, i.e., the smaller the size and/or the higher the concentration of such particles, the smaller the size of the final toner particles.

Promoters, which are water-soluble and affect the hydrophilic/hydrophobic balance of the solid dispersing agent in the aqueous solution, are employed to drive the solid dispersing agent to the polymer/solvent droplet-water interface. Useful promoters include, for example, sulfonated polystyrenes, alginates, carboxymethyl cellulose, methoxycellulose, gelatin, casein, albumin, gluten, tetramethyl ammonium hydroxide or chloride, diethylaminoethylmethacrylate, and water-soluble complex resinous amine condensation products such as the products of diethanolamine and adipic acid.

A particularly useful promoter is poly(adipic acid-co-methylaminoethanol). Generally, the promoter is used in amounts of from about 0.2 parts to about 0.6 parts per 100 parts of aqueous solution.

Suitable colorants, which can be pigments or dyes and can be used individually or in mixtures, are disclosed in, for example, U.S. Reissue Pat. No. 31,072 and U.S. Pat. Nos. 4,160,644; 4,416,965; 4,414,152; and 2,229,513; the disclosures of which are incorporated herein by reference. Colorants are generally employed in the range of, preferably about 1 wt. % to about 30 wt. %, more preferably, about 2 wt. % to about 15 wt. %, based on the total weight of the toner powder. They can be in the form of dry powders, aqueous dispersions, or wet cakes. Colorants milled by methods such as media-mill or ball-mill can be also be used.

The pH of commercial carbon blacks, vary over a wide range, depending on the amount of chemisorbed oxygen present on surface of the carbon particles. Acidic carbon blacks having a pH less than 7 are useful colorants in the process of the present invention.

The invention will be more fully understood by reference to the following illustrative examples:

Standard Procedure

To 100 g of ethyl acetate was added 23.5 g of KAO polyester toner binder resin, 0.1 g of charge control agent Orient BONTRON® E-88 and a colorant. This mixture was stirred overnight to form the organic phase in the evaporative limited coalescence process. The organic phase was then mixed with an aqueous phase comprising 375 g of pH4 buffer containing 8.3 g of NALCOAG® 1060 and 2.7 g of a 10% solution of standard poly(adipic acid-co-methylaminoethanol). This mixture was then subjected to very high shear using a Silverson Model L4R mixer, followed by a homogenizer by MICROFLUIDIZER® Model 110F homogenizer. Upon exiting, the solvent was removed from the formed particles by stirring overnight at room temperature in an open container. These particles were filtered, washed with water, and dried. The aqueous filtrates were clear with no evidence of free pigment in the water phase, indicating the pigments were contained within the toner particles, in all of the examples listed below except Comparative Example 2 and Example 6, in which an organic magenta dye was used and the aqueous filtrate showed a pale magenta color. The particle size was measured using a COULTER® Multisizer II instrument with a 70 μm aperture.

COMPARATIVE EXAMPLE 1

In this comparative example, the standard procedure was used, except that 1.5 g of bridged aluminum phthalocyanine pigment in dry powder form (from Eastman Kodak Co.) was added to the organic phase. The toner particle size was approximately 6.5 μm volume-average.

EXAMPLE 1

Using the standard procedure, 1.5 g of bridged aluminum phthalocyanine pigment in dry powder form, was added to the aqueous phase. The toner particle size was approximately 6.4 μm volume-average, which is very close to that of Comparative Example 1.

EXAMPLE 2

The bridged aluminum phthalocyanine pigment in dry powder form was ball-milled for 27 hours, and the resulting product was used in the procedure of Example 1. The toner particle size was approximately 7.1 μm volume-average.

EXAMPLE 3

The procedure of Example 1 was repeated except that HELIOGEN® Green 8720 wet cake pigment (from BASF) was used. The toner particle size was approximately 6.5 μm volume-average.

EXAMPLE 4

The procedure of Example 1 was repeated with the exception that Toner Yellow 180 in dry powder form (from Hoechst) was used. The toner particle size was approximately 5.7 μm volume-average.

EXAMPLE 5

The procedure of Example 1 was repeated with the exception that HOSTAPERM® Pink E02 in dry powder form (from Clariant Co.) was used. The toner particle size was approximately 5.8 μm volume-average.

COMPARATIVE EXAMPLE 2

In the standard procedure, 1.5 g of NEOPEN® Magenta SE1378 organic dye in dry powder (from BASF) was added to the organic phase. The toner particle size was approximately 6.6 μm volume-average.

EXAMPLE 6

The procedure of Comparative Example 2 was repeated with the exception that NEOPEN® Magenta SE1378 dye was dispersed in the aqueous phase instead of the organic phase. The toner particle size was approximately 6.2 μm volume-average, similar to that obtained in Comparative Example 2, and the dye was substantially contained within the toner particles. Once again, this shows the present invention can be extended to a dye.

COMPARATIVE EXAMPLE 3

The procedure of Example 1 was repeated with the exception that BLACK PEARLS® 280 carbon black (from Cabot), which has a pH of about 7 in dry powder form, was used instead of bridged aluminum phthalocyanine. It did not form stable toner particles.

EXAMPLE 7

The procedure of Comparative Example 3 was repeated using MONARCH® 800 (from Cabot), which has a pH of 2.5 in dry powder form. The toner particle size was approximately 7.0 μm volume-average.

EXAMPLE 8

The procedure of Example 7 was repeated with the exception that REGAL® 400R (from Cabot), which has a pH of 4.0 in dry powder form, was used. The toner particle size was approximately 6.8 μm volume-average.

EXAMPLE 9

The procedure of Example 7 was repeated, with the exception that, RAVEN® 2000 (from Columbian Chemicals Co.), which has a pH of 6.0 in dry powder form, was used. The toner particle size was approximately 8.1 μm volume-average.

The invention has been described in detail with particular reference to certain preferred embodiments thereof, but it is understood that variations and modifications can be effected within the spirit and scope of the invention, which is defined by the claims that follow.

What is claimed is:

1. A process for the preparation of colored polymeric toner particles comprising:

a) forming an organic phase by dissolving an organic polymer and, optionally, one or more additives in a water-immiscible organic solvent, b) forming a dispersion by combining the organic phase with an aqueous phase comprising a particulate stabilizer, a colorant, and, optionally, a promoter, with the proviso that when the colorant is carbon black, said carbon black is an acidic carbon black having a pH less than 7;

c) homogenizing the dispersion, thereby forming droplets containing the organic solvent, organic polymer, and colorant;

d) removing the organic solvent from the droplets, thereby forming colored polymeric toner particles; and e) separating and drying the colored polymeric toner particles.

2. The process of claim 1 wherein said organic polymer is a vinyl polymer or copolymer.

3. The process of claim 2 wherein said organic polymer is a styrene-acrylic copolymer.

4. The process of claim 1 wherein said organic polymer is a monomer condensation copolymer.

5. The process of claim 4 wherein said organic polymer is a polyester.

6. The process of claim 1 wherein said additive is a charge control agent, a wax, or a lubricant.

7. The process of claim 6 wherein said additive is a charge control agent, the amount of said charge control agent being about 0.1–5 wt. % based on the weight of said toner particles.

8. The process of claim 1 wherein said water-immiscible organic solvent is selected from the group consisting of dichloromethane, ethyl acetate, propyl acetate, methyl ethyl ketone, trichloromethane, carbon tetrachloride, ethylene chloride, trichloroethane, toluene, xylene, cyclohexanone, and 2-nitropropane.

9. The process of claim 8 wherein said water-immiscible organic solvent is selected from the group consisting of dichloromethane, ethyl acetate, and propyl acetate.

10. The process of claim 1 wherein said particulate stabilizer is a crosslinked latex polymer or an inorganic oxide.

11. The process of claim 10 wherein said particulate stabilizer is colloidal silica.

12. The process of claim 1 wherein said promoter is selected from the group consisting of sulfonated polystyrenes, alginates, carboxymethyl cellulose, methoxycellulose, gelatin, glue, casein, albumin, gluten, tetramethylammonium hydroxide, tetramethylammonium chloride, diethylaminoethylmethacrylate, water-soluble resinous amine-dicarboxylic acid condensation products, such as the products of diethanol amine and adipic acid, and water-soluble condensation products of ethylene oxide, urea and formaldehyde and polyethyleneimine.

13. The process of claim 12 wherein said promoter is poly(adipic acid-co-methylaminoethanol).

14. The process of claim 1 wherein said promoter is present in an amount of about 0.2 parts to about 0.6 parts per 100 parts of said aqueous phase.

15. The process of claim 1 wherein said colorant is a pigment or a dye.

16. The process of claim 1 wherein said colorant is in the form of a wet cake.

17. The process of claim 1 wherein said colorant is present in an amount of about 1 wt. % to about 30 wt. % based on the weight of said toner particles.

18. The process of claim 17 wherein said colorant is present in an amount of about 2 wt. % to about 15 wt. % based on the weight of said toner particles.

* * * * *